US011283188B2

(12) United States Patent
Choi et al.

(10) Patent No.: US 11,283,188 B2
(45) Date of Patent: Mar. 22, 2022

(54) ANTENNA MODULE INCLUDING COMPENSATOR FOR COMPENSATING ELECTRICAL PATH DIFFERENCE AND ELECTRONIC DEVICE INCLUDING THE SAME

(71) Applicant: Samsung Electronics Co., Ltd., Suwon-si (KR)

(72) Inventors: Seungho Choi, Suwon-si (KR); Seungtae Ko, Suwon-si (KR); Yoongeon Kim, Suwon-si (KR); Youngju Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 91 days.

(21) Appl. No.: 16/840,018

(22) Filed: Apr. 3, 2020

(65) Prior Publication Data

US 2020/0321707 A1 Oct. 8, 2020

(30) Foreign Application Priority Data

Apr. 3, 2019 (KR) ..... 10-2019-0039067

(51) Int. Cl.
*H01Q 21/00* (2006.01)
*H01Q 5/35* (2015.01)
(Continued)

(52) U.S. Cl.
CPC ..... *H01Q 21/0025* (2013.01); *H01Q 1/38* (2013.01); *H01Q 5/35* (2015.01); *H01Q 13/106* (2013.01); *H01Q 21/22* (2013.01); *G16Y 10/75* (2020.01)

(58) Field of Classification Search
CPC ..... H01Q 21/0025; H01Q 5/35; H01Q 1/38; H01Q 13/106; H01Q 21/22; H01Q 5/50;
(Continued)

(56) References Cited

U.S. PATENT DOCUMENTS

H1773 H 1/1999 Cheston et al.
9,252,498 B2 2/2016 Lee
(Continued)

FOREIGN PATENT DOCUMENTS

JP 2014176068 A 9/2014

OTHER PUBLICATIONS

European Search Report dated Aug. 24, 2020 in connection with European Patent Application No. 20 16 7581, 11 pages.

*Primary Examiner* — David E Lotter

(57) ABSTRACT

The present disclosure relates to a communication method and system for converging a $5^{th}$-Generation (5G) communication system for supporting higher data rates beyond a $4^{th}$-Generation (4G) system with a technology for Internet of Things (IoT). The present disclosure may be applied to intelligent services based on the 5G communication technology and the IoT-related technology, such as smart home, smart building, smart city, smart car, connected car, health care, digital education, smart retail, security and safety services. An antenna module includes a printed circuit board on which at least one layer is stacked and including a feed port formed at a portion of the upper surface thereof; a first antenna array disposed on the upper surface of the printed circuit board; a second antenna array disposed on the upper surface of the printed circuit board and spaced apart from the first antenna array; a first feed line to electrically connect the feed port and the first antenna array, the first feed line including a compensator to adjust the length of the first feed line; and a second feed line to electrically connect the feed port and the second antenna array.

17 Claims, 18 Drawing Sheets

(51) Int. Cl.

| | |
|---|---|
| ***H01Q 1/38*** | (2006.01) |
| ***H01Q 13/10*** | (2006.01) |
| ***H01Q 21/22*** | (2006.01) |
| *G16Y 10/75* | (2020.01) |

(58) Field of Classification Search
CPC .. H01Q 21/0075; H01Q 1/2283; H01Q 1/243; H01Q 21/0006; H01Q 1/46; G16Y 10/75; H01P 5/12; H01P 1/184; H01P 9/00
See application file for complete search history.

(56) References Cited

U.S. PATENT DOCUMENTS

| | | | | |
|---|---|---|---|---|
| 2004/0130491 | A1 | 7/2004 | Hayes | |
| 2017/0310017 | A1* | 10/2017 | Howard | H01Q 21/0006 |
| 2019/0252771 | A1* | 8/2019 | Yong | H01Q 21/065 |

* cited by examiner

ANTENNA MODULE INCLUDING COMPENSATOR FOR COMPENSATING ELECTRICAL PATH DIFFERENCE AND ELECTRONIC DEVICE INCLUDING THE SAME

CROSS-REFERENCE TO RELATED APPLICATION

This application is based on and claims priority under 35 U.S.C. 119 to Korean Patent Application No. 10-2019-0039067 filed on Apr. 3, 2019 in the Korean Intellectual Property Office, the disclosure of which is herein incorporated by reference in its entirety.

BACKGROUND

1. Field

The disclosure relates to an antenna module including a compensator to compensate for an electrical path difference and an electronic device including the antenna module.

2. Description of Related Art

To meet the demand for wireless data traffic having increased since deployment of 4G communication systems, efforts have been made to develop an improved 5G or pre-5G communication system. Therefore, the 5G or pre-5G communication system is also called a 'Beyond 4G Network' or a 'Post LTE System'. The 5G communication system is considered to be implemented in higher frequency (mmWave) bands, e.g., 60 GHz bands, so as to accomplish higher data rates. To decrease propagation loss of the radio waves and increase the transmission distance, the beamforming, massive multiple-input multiple-output (MIMO), Full Dimensional MIMO (FD-MIMO), array antenna, an analog beam forming, large scale antenna techniques are discussed in 5G communication systems. In addition, in 5G communication systems, development for system network improvement is under way based on advanced small cells, cloud Radio Access Networks (RANs), ultra-dense networks, device-to-device (D2D) communication, wireless backhaul, moving network, cooperative communication, Coordinated Multi-Points (CoMP), reception-end interference cancellation and the like. In the 5G system, Hybrid FSK and QAM Modulation (FQAM) and sliding window superposition coding (SWSC) as an advanced coding modulation (ACM), and filter bank multi carrier (FBMC), non-orthogonal multiple access (NOMA), and sparse code multiple access (SCMA) as an advanced access technology have been developed.

The Internet, which is a human centered connectivity network where humans generate and consume information, is now evolving to the Internet of Things (IoT) where distributed entities, such as things, exchange and process information without human intervention. The Internet of Everything (IoE), which is a combination of the IoT technology and the Big Data processing technology through connection with a cloud server, has emerged. As technology elements, such as "sensing technology", "wired/wireless communication and network infrastructure", "service interface technology", and "Security technology" have been demanded for IoT implementation, a sensor network, a Machine-to-Machine (M2M) communication, Machine Type Communication (MTC), and so forth have been recently researched. Such an IoT environment may provide intelligent Internet technology services that create a new value to human life by collecting and analyzing data generated among connected things. IoT may be applied to a variety of fields including smart home, smart building, smart city, smart car or connected cars, smart grid, health care, smart appliances and advanced medical services through convergence and combination between existing Information Technology (IT) and various industrial applications.

In line with this, various attempts have been made to apply 5G communication systems to IoT networks. For example, technologies such as a sensor network, Machine Type Communication (MTC), and Machine-to-Machine (M2M) communication may be implemented by beamforming, MIMO, and array antennas. Application of a cloud Radio Access Network (RAN) as the above-described Big Data processing technology may also be considered to be as an example of convergence between the 5G technology and the IoT technology.

SUMMARY

In an antenna module including a plurality of antenna arrays, phases of electrical signals applied to the individual antenna arrays may be different from each other. To solve this problem, the electrical path of the antenna module may be artificially adjusted so that the phase difference between the electrical signals applied to the individual antenna arrays becomes 360 degrees. However, even with this adjustment, the phase difference between electrical signals applied to the individual antenna arrays is 360 degrees only in a specific frequency band, and the phase difference between electrical signals applied to the individual antenna arrays may be not maintained at 360 degrees in a wider frequency band. Accordingly, to secure the gain at a specific level or higher in a wide frequency band, an antenna module structure that can resolve the above problem is required.

According to the disclosure, there is provided an antenna module. The antenna module may include: a printed circuit board on which at least one layer is stacked and including a feed port formed at a portion of the upper surface thereof; a first antenna array disposed on the upper surface of the printed circuit board; a second antenna array disposed on the upper surface of the printed circuit board and spaced apart from the first antenna array; a first feed line to electrically connect the feed port and the first antenna array; and a second feed line to electrically connect the feed port and the second antenna array, wherein the first feed line includes a compensator to adjust the length of the first feed line.

According to the disclosure, there is provided an antenna module. The antenna module may include: a printed circuit board on which at least one layer is stacked and including a feed port formed at a portion of the upper surface thereof; a first antenna array disposed on the upper surface of the printed circuit board; a second antenna array disposed on the upper surface of the printed circuit board and spaced apart from the first antenna array; a third antenna array disposed on the upper surface of the printed circuit board and spaced apart from the first antenna array and the second antenna array; a first feed line to electrically connect the feed port and the first antenna array; a second feed line to electrically connect the feed port and the second antenna array; and a third feed line to electrically connect the feed port and the third antenna array, wherein the first feed line includes a compensator to adjust the length of the first feed line.

According to the disclosure, there is provided an electronic device including an antenna module. The antenna module may include: a printed circuit board on which at least one layer is stacked and including a feed port formed at a portion of the upper surface thereof; a first antenna array disposed on the upper surface of the printed circuit board; a second antenna array disposed on the upper surface of the printed circuit board and spaced apart from the first antenna array; a third antenna array disposed on the upper surface of the printed circuit board and spaced apart from the first antenna array and the second antenna array; a first feed line to electrically connect the feed port and the first antenna array; a second feed line to electrically connect the feed port and the second antenna array; and a third feed line to electrically connect the feed port and the third antenna array, wherein the first feed line includes a compensator to adjust the length of the first feed line.

According to an embodiment of the disclosure, in a wide frequency band, the phase difference between electrical signals supplied to individual antenna arrays constituting the antenna module may not occur. As such a phase difference does not occur, the gain of the radio wave formed by the side lobe of the antenna module is lowered, thereby improving the gain of the radio wave formed by the main lobe.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
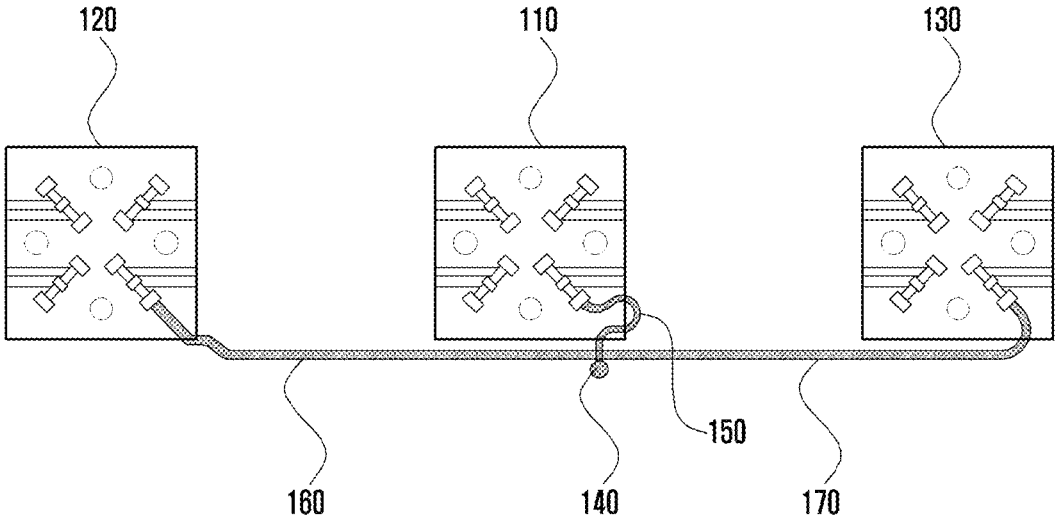
FIG. 1 illustrates the structure of an antenna module according to the related art.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, embodiments of the disclosure are described in detail with reference to the accompanying drawings. Descriptions of functions and structures well known in the art and not directly related to the disclosure may be omitted for clarity and conciseness without obscuring the subject matter of the disclosure.

In the drawings, some elements are exaggerated, omitted, or only outlined in brief, and thus may be not drawn to scale. The same or similar reference symbols are used throughout the drawings to refer to the same or like parts.

The aspects, features, and advantages of certain embodiments of the disclosure will be more apparent from the following detailed description taken in conjunction with the accompanying drawings. The description of the various embodiments is to be construed as examples only and does not describe every possible instance of the disclosure. It should be apparent to those skilled in the art that the following description of various embodiments of the disclosure is provided for illustrative purposes only and not for the purpose of limiting the disclosure as defined by the appended claims and their equivalents. The same reference symbols are used throughout the description to refer to the same parts.

Meanwhile, it is known to those skilled in the art that blocks of a flowchart (or sequence diagram) and a combination of flowcharts may be represented and executed by computer program instructions. These computer program instructions may be loaded on a processor of a general purpose computer, special purpose computer, or programmable data processing equipment. When the loaded program instructions are executed by the processor, they create a means for carrying out functions described in the flowchart. As the computer program instructions may be stored in a computer readable memory that is usable in a specialized computer or a programmable data processing equipment, it is also possible to create articles of manufacture that carry out functions described in the flowchart. As the computer program instructions may be loaded on a computer or a programmable data processing equipment, when executed as processes, they may carry out steps of functions described in the flowchart.

A block of a flowchart may correspond to a module, a segment or a code containing one or more executable instructions implementing one or more logical functions, or to a part thereof. In some cases, functions described by blocks may be executed in an order different from the listed order. For example, two blocks listed in sequence may be executed at the same time or executed in reverse order.

In the description, the word "unit", "module", or the like may refer to a software component or hardware component such as an FPGA or ASIC capable of carrying out a function or an operation. However, "unit" or the like is not limited to hardware or software. A unit or the like may be configured so as to reside in an addressable storage medium or to drive one or more processors. Units or the like may refer to software components, object-oriented software components, class components, task components, processes, functions, attributes, procedures, subroutines, program code segments, drivers, firmware, microcode, circuits, data, databases, data structures, tables, arrays, or variables. A function provided by a component and unit may be a combination of smaller components and units, and it may be combined with others to compose large components and units. Components and units may be configured to drive a device or one or more processors in a secure multimedia card. In a certain embodiment, a module or unit may include at least one processor.

FIG. 1 illustrates the structure of an antenna module according to the related art.

In one embodiment, the antenna module may include a first antenna 110, a second antenna 120, and a third antenna 130. In various embodiments, the first antenna 110, the second antenna 120, and the third antenna 130 may be disposed on the upper surface of a printed circuit board and may radiate radio waves (or beams) in a specific direction.

In one embodiment, a feed port 140 may be formed on the upper surface of the printed circuit board. In various embodiments, a wireless communication chip (e.g., RFIC) may be disposed on the bottom surface of the printed circuit board to supply an electrical signal for radiating radio waves. In one embodiment, the electrical signal supplied by the wireless communication chip may be supplied to each antenna disposed on the upper surface of the printed circuit board through the feed port 140.

In one embodiment, the first antenna 110 may be disposed at a position close to the feed port 140 on the upper surface of the printed circuit board, and the second antenna 120 and the third antenna 130 may be spaced apart by a preset distance from the feed port 140. In various embodiments, the first antenna 110 may receive the electrical signal supplied by the feed port 140 through a first feed line 150; the second antenna 120 may receive the electrical signal supplied by the feed port 140 through a second feed line 160; and the third antenna 130 may receive the electrical signal supplied by the feed port 140 through a third feed line 170.

In one embodiment, as the first antenna 110 is disposed at a position close to the feed port 140, the length of the first feed line 150 may be shorter than the length of the second feed line 160 and the length of the third feed line 170. In various embodiments, the lengths of the second feed line 160 and the third feed line 170 may be the same.

Meanwhile, in the description, the length of a feed line may indicate the electrical length of the feed line. That is, the length of a feed line may be the length of the electrical path through which the electrical signal supplied through the feed line passes. Hence, the phase of the electrical signal supplied at the last end of the feed line may vary depending upon the length of the feed line.

In one embodiment, the phase of the electrical signal supplied to the first antenna 110 may be different from the phase of the electrical signal supplied to the second antenna 120 and the third antenna 130. In various embodiments, due to the difference between the length of the first feed line 150 and the length of the second feed line 160 and the third feed line 170, the phase of the electrical signal supplied to the first antenna 110 may be different from the phase of the electrical signal supplied to the second antenna 120 and the third antenna 130.

In one embodiment, the phase difference between the phase of the electrical signal supplied to the first antenna 110 and the phase of the electrical signal supplied to the second antenna 120 and the third antenna 130 may be 360 degrees. In various embodiments, the phase difference between the phase of the electrical signal supplied to the first antenna 110 and the phase of the electrical signal supplied to the second antenna 120 and the third antenna 130 can be set to 360 degrees by adjusting the length of the second feed line 160 and the third feed line 170. This may prevent the gain of the antenna module from decreasing at a specific frequency.

Figure 2:
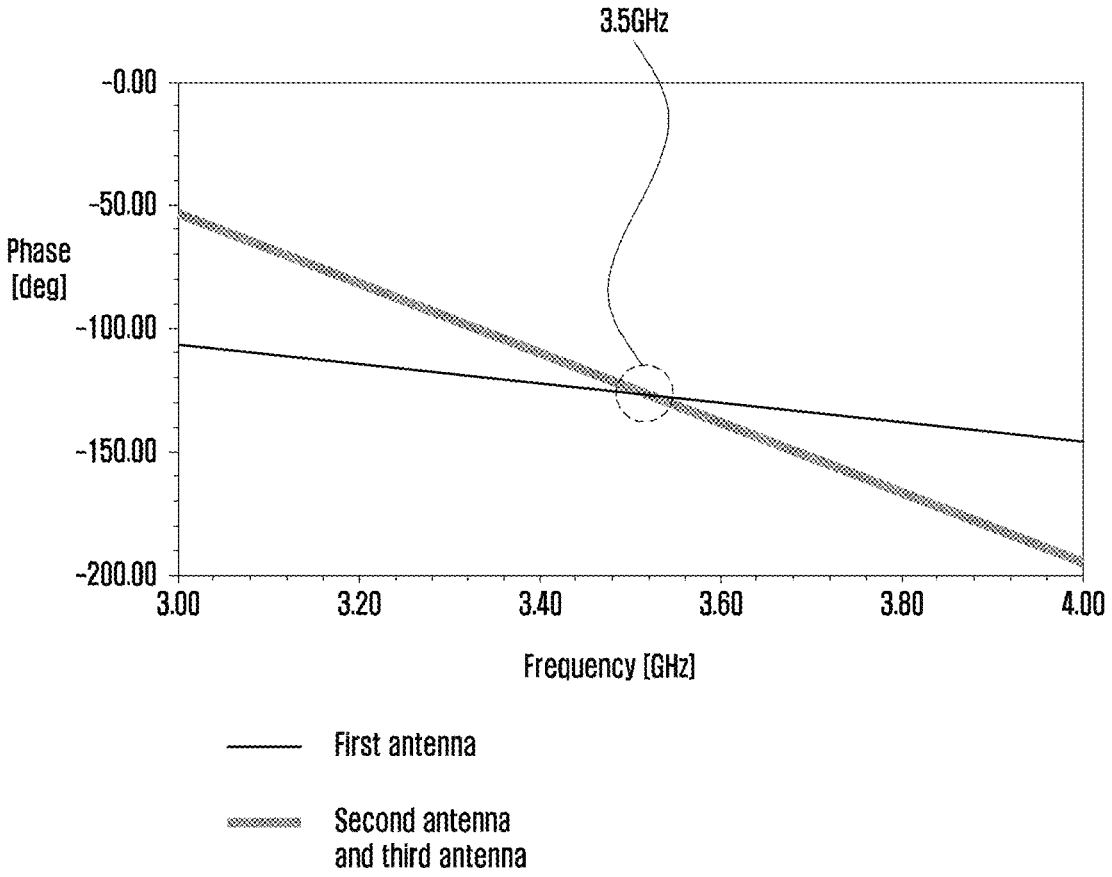
FIG. 2 is a graph showing the phase difference between electrical signals supplied to individual antennas in the antenna module structure according to the related art.

FIG. 2 is a graph showing the phase difference between electrical signals supplied to individual antennas in the antenna module structure according to the related art.

With reference to FIG. 2, in the case of a frequency band of 3.5 GHz, there is no difference between the phase of the radio wave radiated through the first antenna and the phase of the radio waves radiated through the second and third antennas. When the frequency increases or decreases from 3.5 GHz, it can be seen that the difference between the phase of the radio wave radiated through the first antenna and the phase of the radio waves radiated through the second and third antennas increases.

As will be described later, in the frequency band other than 3.5 GHz, the phase of the radio wave radiated through the first antenna may be different from the phase of the radio waves radiated through the second and third antennas. This is because the electrical length of the first feed line may be different from the electrical length of the second feed line and the third feed line according to the frequency band.

Figure 3:
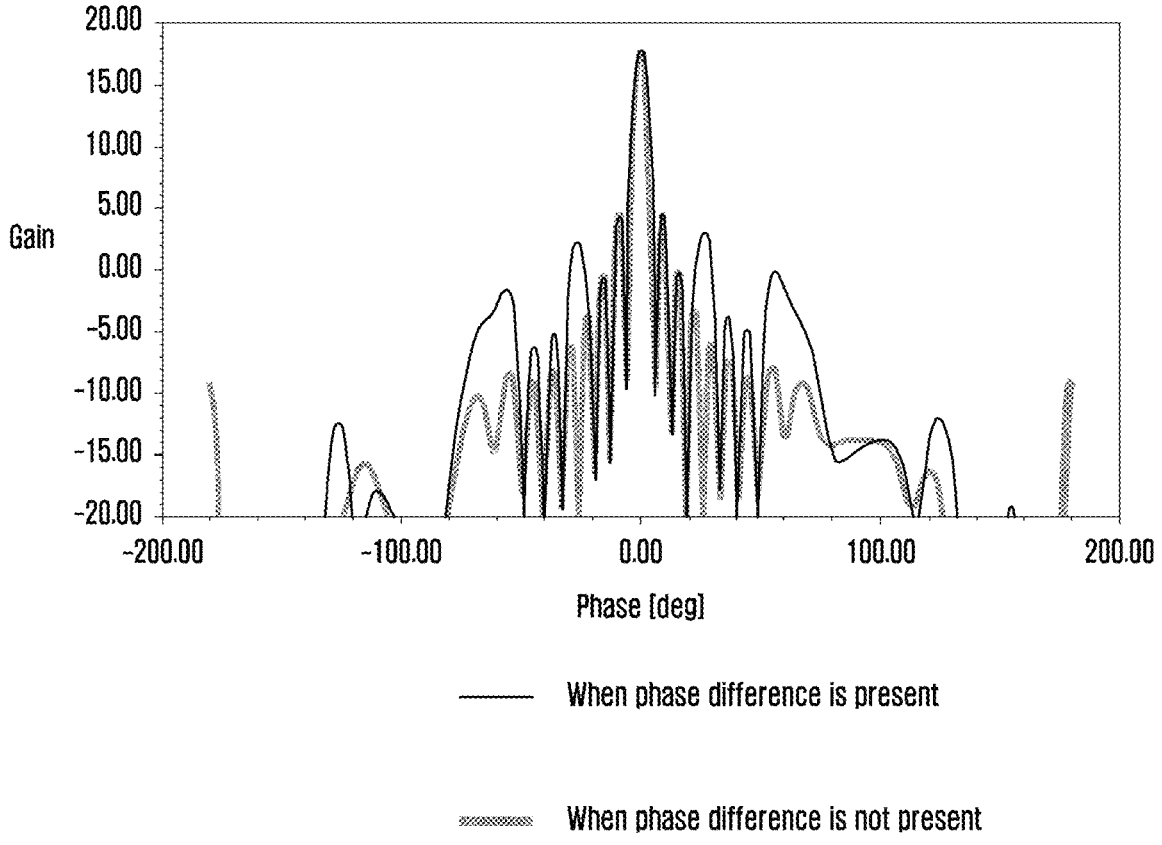
FIG. 3 illustrates the direction of radio waves formed when a phase difference occurs between electrical signals supplied to individual antennas and when a phase difference does not occur.

FIG. 3 illustrates the direction of radio waves formed when a phase difference occurs between electrical signals supplied to individual antennas and when a phase difference does not occur.

With reference to FIG. 3, it can be seen that the amount of radio waves radiated in the direction of the side lobe of the antenna module increases when a difference occurs between the phase of the electrical signal supplied to the first antenna and the phase of the electrical signal supplied to the second and third antennas compared to when a difference does not occur between the phase of the electrical signal supplied to the first antenna and the phase of the electrical signal supplied to the second and third antennas.

In one embodiment, radio waves radiated by the antenna module may be in the direction of the main lobe, side lobe, and back lobe. In various embodiments, the gain of the antenna module may increase as more radio waves are radiated in the main lobe direction and may decrease as more radio waves are radiated in the side lobe or back lobe direction.

In one embodiment, radio waves having an angle of more than +30 degrees or less than −30 degrees may be radio waves radiated in the side lobe or back lobe direction. It can be seen from FIG. 3 that the amount of radio waves radiated in the direction of the side lobe or the back lobe increases when there is a difference between the phase of the electrical signal supplied to the first antenna and the phase of the electrical signal supplied to the second and third antennas.

Figure 4:
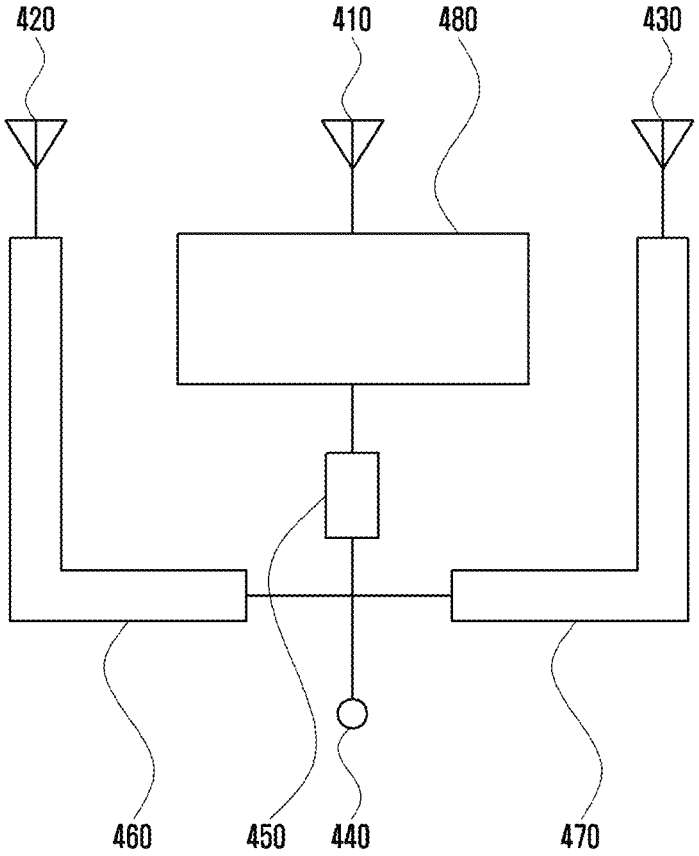
FIG. 4 illustrates the structure of an antenna module according to an embodiment of the disclosure.

FIG. 4 illustrates the structure of an antenna module according to an embodiment of the disclosure.

With reference to FIG. 4, in one embodiment, the antenna module may include: a printed circuit board on which at least one layer is stacked and including a feed port 440 formed at a portion of the upper surface thereof; a first antenna array 410 disposed on the upper surface of the printed circuit board; a second antenna array 420 disposed on the upper surface of the printed circuit board and spaced apart from the first antenna array 410; a third antenna array 430 disposed on the upper surface of the printed circuit board and spaced apart from the first antenna array 410 and the second antenna array 420; a first feed line 450 electrically connecting the feed port 440 and the first antenna array 410; a second feed line 460 electrically connecting the feed port 440 and the second antenna array 420; and a third feed line 470 electrically connecting the feed port 440 and the third antenna array 430, wherein the first feed line 450 may include a compensator 480 to adjust the length of the first feed line 450.

In one embodiment, the first antenna array 410 may be disposed at a position closer to the feed port 440 than the second antenna array 420 and the third antenna array 430. In various embodiments, the length of the first feed line 450 may be shorter than the length of the second feed line 460 and the third feed line 470, and the length of the second feed line 460 may be the same as the length of the third feed line 470.

In one embodiment, when an electrical signal having a phase of $\theta_0$ is supplied through the feed port 440, the phase of the electrical signal changed by the first feed line 450 may be $\Delta\theta_1$ and the phase of the electrical signal changed by the second feed line 460 and the third feed line 470 may be $\Delta\theta_2$. In various embodiments, the relationship between $\Delta\theta_1$ and $\Delta\theta_2$ may be determined based on Equation 1 below.

$$\Delta\theta_2=\Delta\theta_1*n*360° \quad \text{[Equation 1]}$$

$\Delta\theta_1$: phase of the electrical signal changed by the first feed line $\Delta\theta_2$: phase of the electrical signal changed by the second feed line and the third feed line n: integer greater than or equal to 1

In one embodiment, the lengths of the first feed line 450, the second feed line 460, and the third feed line 470 may be determined based on Equation 1 so as to reduce the phase difference between electrical signals supplied to the individual antenna arrays at a specific frequency. In various embodiments, the electrical lengths of the first feed line 450, the second feed line 460, and the third feed line 470 can be made identical by use of the compensator 480 electrically connected to the first feed line 450.

In the description, the electrical length may not mean the physical length of a feed line. In one embodiment, the electrical length of a feed line may be a factor that determines the phase of the electrical signal passing through the feed line. For example, the length of a feed line may be a factor for determining the impedance of the feed line.

In one embodiment, although the length of the first feed line 450 is different from the length of the second feed line 460 and the third feed line 470, the phase of the electrical signal supplied to the first antenna array 410 may be the same as the phase of the electrical signal supplied to the second antenna array 420 and the third antenna array 430 by use of the compensator 480. For example, if an electrical signal with a phase of 0° is supplied through the feed port 440, the phase of the electrical signal is changed by 40° through the first feed line 450, and the phase of the electrical signal is changed by 400°(360°+40°) through the second feed line 460 and the third feed line 470, the compensator 480 may be configured such that the phase of the electrical signal supplied through the first feed line 450 is additionally changed by 360°. That is, in this case, the phases of the electrical signals supplied to the first antenna array 410, the second antenna array 420, and the third antenna array 430 may all be identical to 400°.

In FIG. 4, three antenna arrays are depicted as constituting one antenna module. However, the number of antenna arrays included in one antenna module may be changed. That is, one antenna module may include two or more antenna arrays. For example, a base station can include 256 antenna arrays, and 64 sub arrays (or antenna modules) each including 4 antenna arrays may be combined to constitute one base station.

Figure 5:
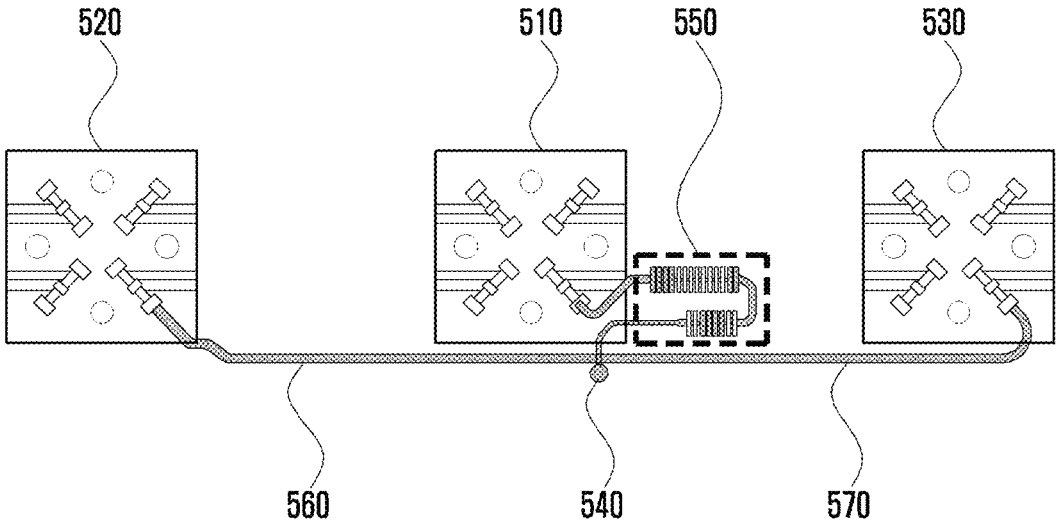
FIG. 5 illustrates the structure of an antenna module according to an embodiment of the disclosure.

FIG. 5 illustrates the structure of an antenna module according to an embodiment of the disclosure.

With reference to FIG. 5, in one embodiment, the antenna module may include: a printed circuit board on which at least one layer is stacked and including a feed port 540 formed at a portion of the upper surface thereof; a first antenna array 510 disposed on the upper surface of the printed circuit board; a second antenna array 520 disposed on the upper surface of the printed circuit board and spaced apart from the first antenna array 510; a third antenna array 530 disposed on the upper surface of the printed circuit board and spaced apart from the first antenna array 510 and the second antenna array 520; a first feed line 550 electrically connecting the feed port 540 and the first antenna array 510; a second feed line 560 electrically connecting the feed port 540 and the second antenna array 520; and a third feed line 570 electrically connecting the feed port 540 and the third antenna array 530, wherein the first feed line 550 may include a compensator to adjust the length of the first feed line 550.

In one embodiment, the first antenna array 510 may be disposed at a position closer to the feed port 540 than the second antenna array 520 and the third antenna array 530. In various embodiments, the length of the first feed line 550 may be shorter than the length of the second feed line 560 and the third feed line 570, and the length of the second feed line 560 may be the same as the length of the third feed line 570.

In one embodiment, when an electrical signal having a phase of $\theta_0$ is supplied through the feed port 540, the phase of the electrical signal changed by the first feed line 550 may be $\Delta\theta_1$ and the phase of the electrical signal changed by the second feed line 560 and the third feed line 570 may be $\Delta\theta_2$. In various embodiments, the relationship between $\Delta\theta_1$ and $\Delta\theta_2$ may be determined based on Equation 2 below.

$$\Delta\theta_2=\Delta\theta_1*n*360° \quad \text{[Equation 2]}$$

$\Delta\theta_1$: phase of the electrical signal changed by the first feed line $\Delta\theta_2$: phase of the electrical signal changed by the second feed line and the third feed line n: integer greater than or equal to 1

In one embodiment, the lengths of the first feed line 550, the second feed line 560, and the third feed line 570 may be determined based on Equation 2 so as to reduce the phase difference between electrical signals supplied to the individual antenna arrays at a specific frequency. In various embodiments, the electrical lengths of the first feed line 550, the second feed line 560, and the third feed line 570 can be made identical by use of the compensator electrically connected to the first feed line 550.

In the description, the electrical length may not mean the physical length of a feed line. In one embodiment, the electrical length of a feed line may be a factor that determines the phase of the electrical signal passing through the feed line. For example, the length of a feed line may be a factor for determining the impedance of the feed line.

In one embodiment, although the length of the first feed line 550 is different from the length of the second feed line 560 and the third feed line 570, the phase of the electrical signal supplied to the first antenna array 510 may be the same as the phase of the electrical signal supplied to the second antenna array 520 and the third antenna array 530 by use of the compensator. For example, if an electrical signal with a phase of 0° is supplied through the feed port 540, the phase of the electrical signal is changed by 50° through the first feed line 550, and the phase of the electrical signal is changed by 400°(360°+40°) through the second feed line 560 and the third feed line 570, the compensator may be configured such that the phase of the electrical signal supplied through the first feed line 550 is additionally changed by 360°. That is, in this case, the phases of the electrical signals supplied to the first antenna array 510, the second antenna array 520, and the third antenna array 530 may all be identical to 400°.

Figure 6A:
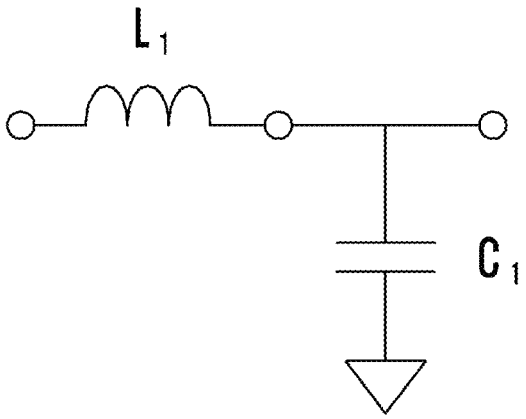
FIG. 6A shows an equivalent circuit of the feed line according to the related art.

FIG. 6A shows an equivalent circuit of the feed line according to the related art.

With reference to FIG. 6A, the feed line according to the related art may be composed of series inductance $L_1$ and parallel capacitance $C_1$. In one embodiment, the impedance $Z_1$ of the feed line according to the related art and the phase $\theta_1$ of the radio wave changed by the feed line may be determined based on Equation 3 below.

$$Z_1 = \sqrt{\frac{L_1}{C_1}},\ \theta_1 = w\sqrt{L_1 \times C_1} \quad \text{[Equation 3]}$$

Figure 6B:
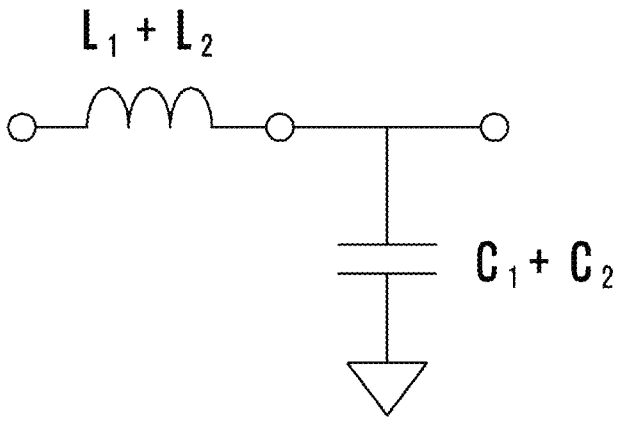
FIG. 6B shows an equivalent circuit of the feed line according to an embodiment of the disclosure.

FIG. 6B shows an equivalent circuit of the feed line according to an embodiment of the disclosure.

With reference to FIG. 6B, the feed line according to an embodiment of the disclosure may be composed of series inductance ($L_1$+$L_2$) and parallel capacitance ($C_1$+$C_2$). In one embodiment, the impedance $Z_2$ of the feed line according to an embodiment of the disclosure and the phase $\theta_2$ of the radio wave changed by the feed line may be determined based on Equation 4 below.

$$Z_1 = \sqrt{\frac{L_1 + L_2}{C_1 + C_2}},\quad \theta_1 = w\sqrt{(L_1 + L_2) \times (C_1 + C_2)} \quad \text{[Equation 4]}$$

Figure 7A:
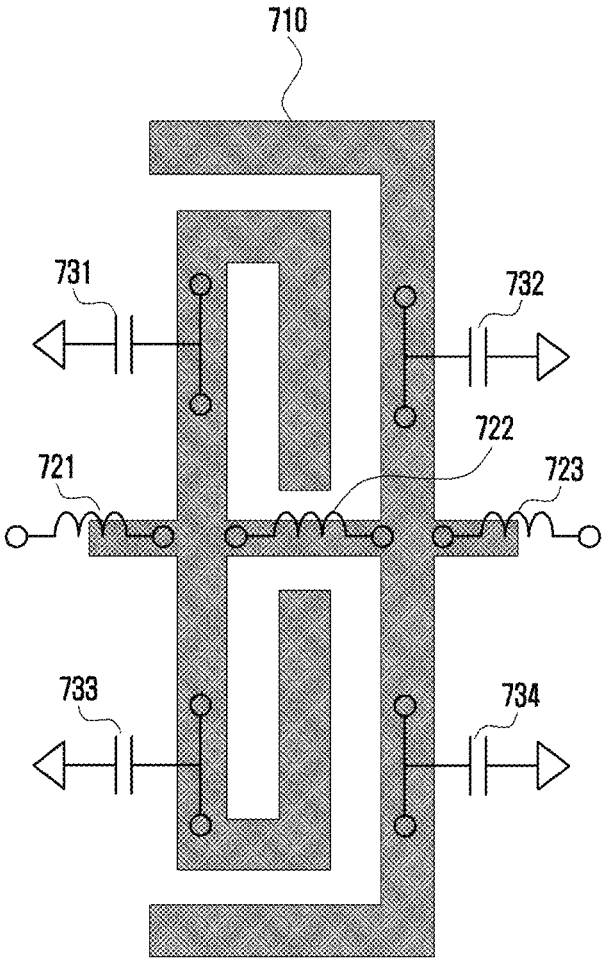
FIG. 7A illustrates the configuration of a metal pattern according to an embodiment of the disclosure.

FIG. 7A illustrates the configuration of a metal pattern according to an embodiment of the disclosure.

In one embodiment, a unit pattern 710 with a shape shown in FIG. 7A may be periodically arranged in the compensator compensating for the electrical length of the feed line. In various embodiments, in the unit pattern 710 shown in FIG. 7A, line components 721, 722 and 723 located at the center may be inductance components connected in series, and stub components 731, 732, 733 and 734 may be capacitor components connected in parallel.

Figure 7B:
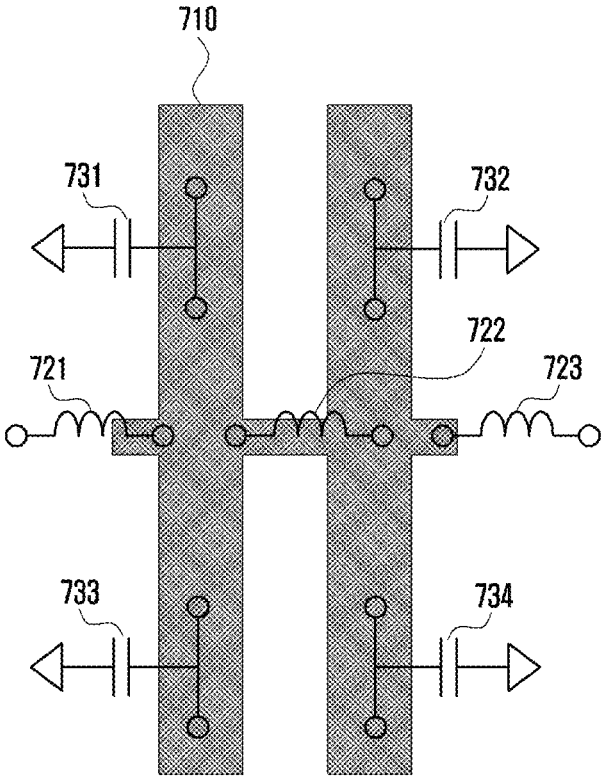
FIG. 7B illustrates the configuration of a metal pattern according to an embodiment of the disclosure.

FIG. 7B illustrates the configuration of a metal pattern according to an embodiment of the disclosure.

In one embodiment, a unit pattern 710 with a shape shown in FIG. 7B may be periodically arranged in the compensator compensating for the electrical length of the feed line. In various embodiments, in the unit pattern 710 shown in FIG. 7B, line components 721, 722 and 723 located at the center may be inductance components connected in series, and stub components 731, 732, 733 and 734 may be capacitor components connected in parallel.

Figure 7C:
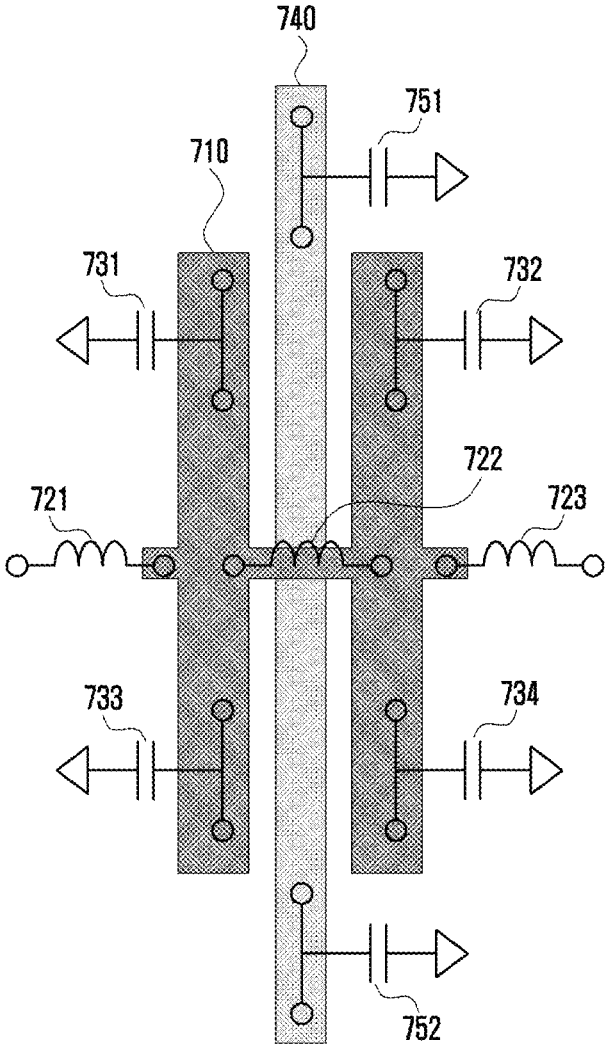
FIG. 7C illustrates the configuration of a metal pattern according to an embodiment of the disclosure.

FIG. 7C illustrates the configuration of a metal pattern according to an embodiment of the disclosure.

In one embodiment, a unit pattern 710 and a metal layer 740 with shapes shown in FIG. 7C may be periodically arranged in the compensator compensating for the electrical length of the feed line. In various embodiments, in the unit pattern 710 shown in FIG. 7C, line components 721, 722 and 723 located at the center may be inductance components connected in series, and stub components 731, 732, 733 and 734 may be capacitor components connected in parallel. The metal layer 740 may affect the compensator as parallel capacitance components 751 and 752.

Figure 7D:
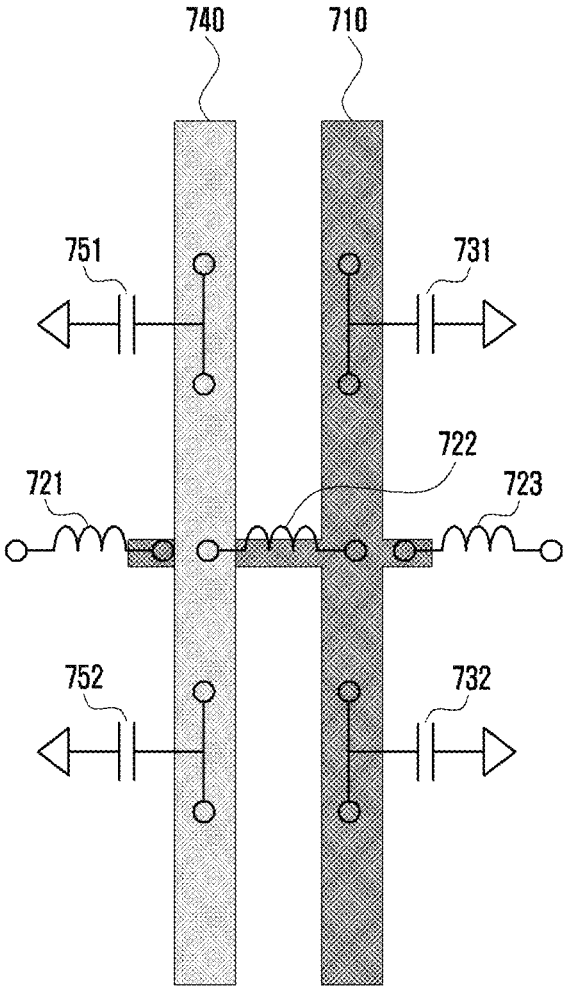
FIG. 7D illustrates the configuration of a metal pattern according to an embodiment of the disclosure.

FIG. 7D illustrates the configuration of a metal pattern according to an embodiment of the disclosure.

In one embodiment, a unit pattern 710 and a metal layer 740 with shapes shown in FIG. 7D may be periodically arranged in the compensator compensating for the electrical length of the feed line. In various embodiments, in the unit pattern 710 shown in FIG. 7D, line components 721, 722 and 723 located at the center may be inductance components connected in series, and stub components 731 and 732 may be capacitor components connected in parallel. The metal layer 740 may affect the compensator as parallel capacitance components 751 and 752.

Figure 7E:
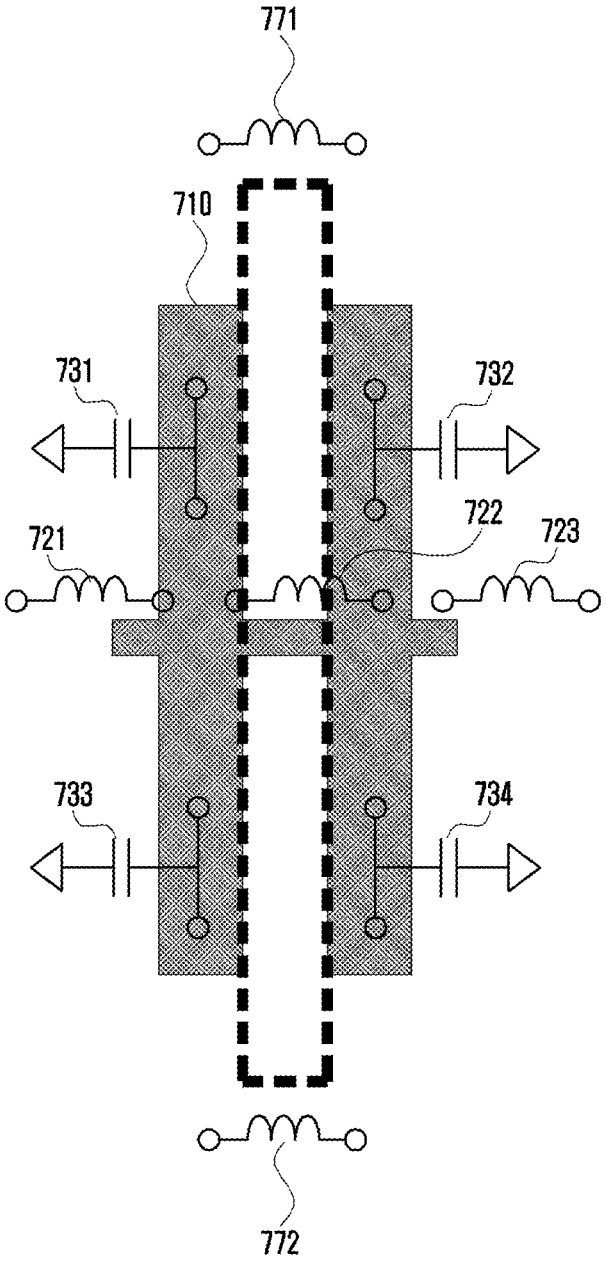
FIG. 7E illustrates the configuration of a metal pattern according to an embodiment of the disclosure.

FIG. 7E illustrates the configuration of a metal pattern according to an embodiment of the disclosure.

In one embodiment, a unit pattern, or metal pattern, 710 with a shape shown in FIG. 7E may be periodically arranged in the compensator compensating for the electrical length of the feed line. In various embodiments, in the unit pattern 710 shown in FIG. 7E, line components 721, 722 and 723 located at the center may be inductance components connected in series, and stub components 731, 732, 733 and 734 may be capacitor components connected in parallel. In one embodiment, a slot 760 may be formed in the ground layer disposed on the bottom surface of the metal pattern 710 (as will be described later, for example, when the metal pattern is disposed on the upper surface of the printed circuit board and the ground layer is disposed on the bottom surface of the printed circuit board), and the slot 760 may affect the compensator as series inductance components 771 and 772.

Figure 8A:
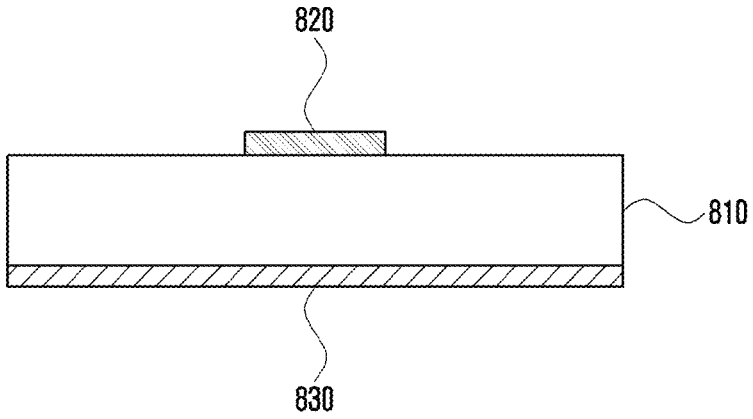
FIG. 8A illustrates a side view of an antenna module including a metal pattern according to an embodiment of the disclosure.

FIG. 8A is a side view of an antenna module including a metal pattern according to an embodiment of the disclosure.

With reference to FIG. 8A, in one embodiment, a planar metal pattern 820 may be formed, using microstrip patterning, on the upper surface of the printed circuit board 810 including at least one layer. In various embodiments, a ground layer 830 may be disposed on the bottom surface of the printed circuit board 810. For example, the compensator of the disclosure may be formed by the metal pattern 820.

In one embodiment, the compensator may be formed by the metal pattern 820 in the antenna module. Although the physical lengths of the feed lines connecting the individual antenna arrays constituting the antenna module to the feed port disposed on the upper surface of the printed circuit board 810 are different from each other, the electrical lengths of the feed lines connecting the individual antenna arrays to the feed port disposed on the upper surface of the printed circuit board 810 can be made identical by the compensator.

Figure 8B:
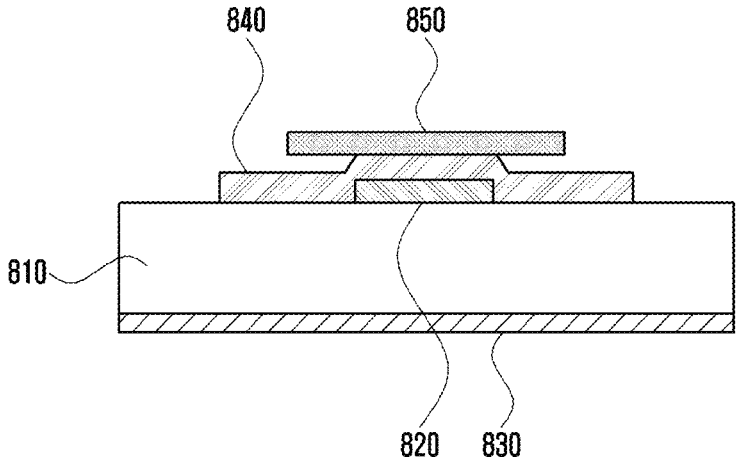
FIG. 8B illustrates a side view of an antenna module including a metal pattern, a dielectric layer, and a metal layer according to an embodiment of the disclosure.

FIG. 8B is a side view of an antenna module including a metal pattern, a dielectric layer, and a metal layer according to an embodiment of the disclosure.

With reference to FIG. 8B, in one embodiment, a planar metal pattern 820 may be formed, using microstrip patterning, on the upper surface of the printed circuit board 810 including at least one layer. In various embodiments, a ground layer 830 may be disposed on the bottom surface of the printed circuit board 810.

In one embodiment, a dielectric layer 840 may be disposed on the upper surface of the metal pattern 820 to prevent oxidation of the metal pattern 820. In various embodiments, the dielectric layer 840 may be formed to surround the metal pattern 820. In one embodiment, a metal layer 850 may be further disposed on the upper surface of the dielectric layer 840 so as to be spaced apart by a preset distance from the metal pattern 820. In various embodiments, the capacitance component of the metal pattern 820 may be adjusted according to the separation distance between the metal pattern 820 and the metal layer 850.

In one embodiment, the compensator may be formed by the metal pattern 820, the dielectric layer 840 and the metal layer 850 in the antenna module. Although the physical lengths of the feed lines connecting the individual antenna arrays constituting the antenna module to the feed port disposed on the upper surface of the printed circuit board 810 are different from each other, the electrical lengths of the feed lines connecting the individual antenna arrays to the feed port disposed on the upper surface of the printed circuit board 810 can be made identical by the compensator.

Figure 8C:
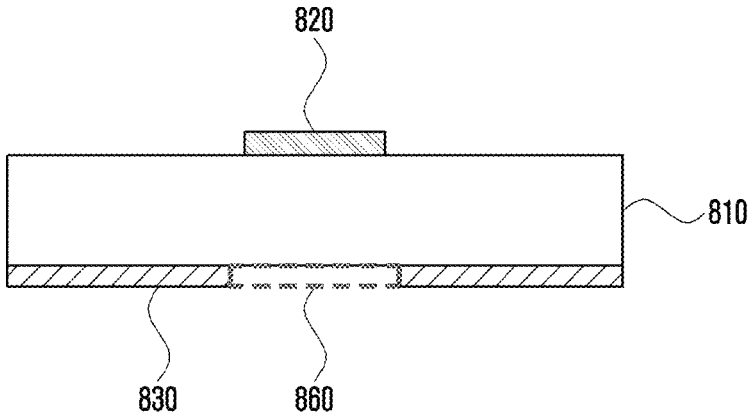
FIG. 8C illustrates a side view of an antenna module including a metal pattern and a slot according to an embodiment of the disclosure.

FIG. 8C is a side view of an antenna module including a metal pattern and a slot according to an embodiment of the disclosure.

With reference to FIG. 8C, in one embodiment, a planar metal pattern 820 may be formed, using microstrip patterning, on the upper surface of the printed circuit board 810 including at least one layer. In various embodiments, a ground layer 830 may be disposed on the bottom surface of the printed circuit board 810. In one embodiment, a slot 860 may be formed at a portion of the ground layer 830 facing the upper surface of the printed circuit board 810 on which the metal pattern 820 is formed. In various embodiments, the inductance component due to the metal pattern 820 may be adjusted according to the size of the slot 860.

In one embodiment, the compensator may be formed by the metal pattern 820 in the antenna module. Although the physical lengths of the feed lines connecting the individual antenna arrays constituting the antenna module to the feed port disposed on the upper surface of the printed circuit board 810 are different from each other, the electrical lengths of the feed lines connecting the individual antenna arrays to the feed port disposed on the upper surface of the printed circuit board 810 can be made identical by the compensator.

Figure 9:
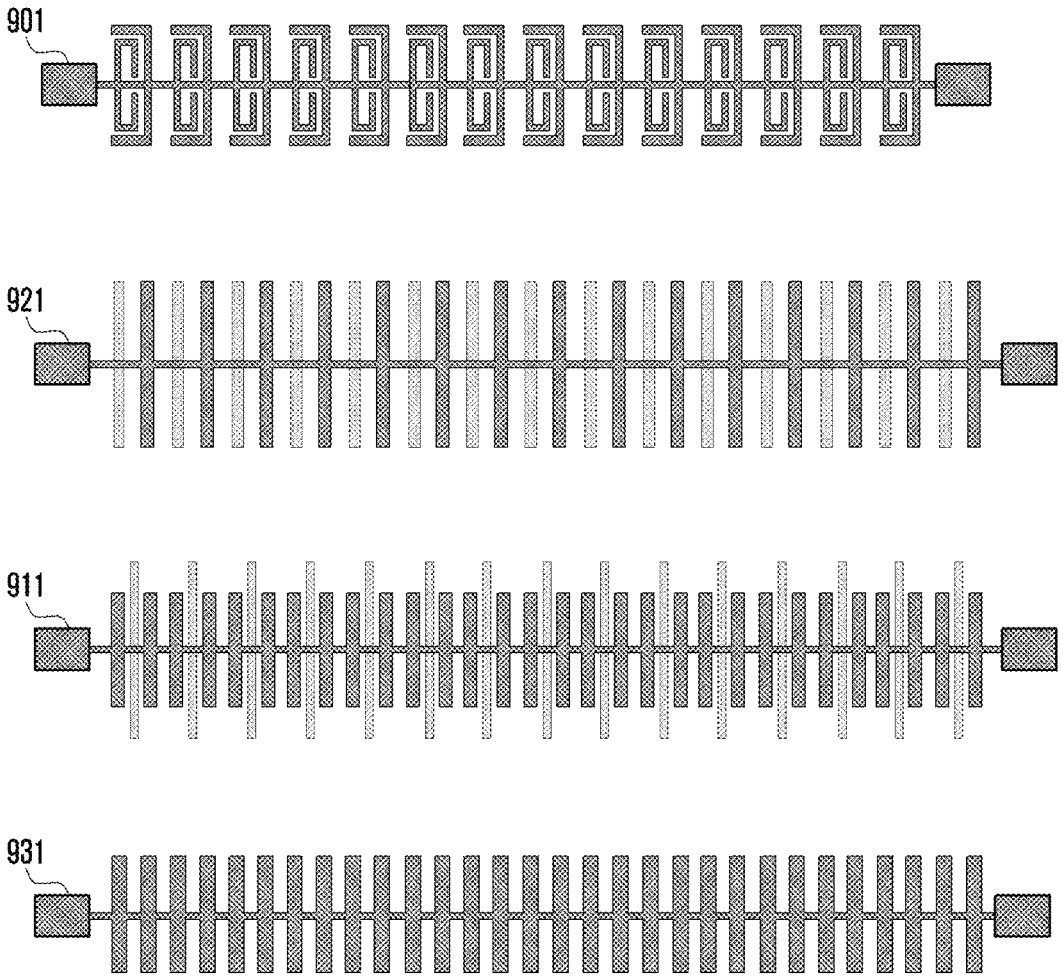
FIG. 9 illustrates a compensator according to an embodiment of the disclosure.

FIG. 9 illustrates a compensator according to an embodiment of the disclosure.

FIG. 9 shows how the unit patterns shown in FIGS. 7A to 7E are periodically arranged in the compensator. More specifically, the first compensator 901 corresponds to a case in which the compensator is formed by periodically arranging the unit pattern shown in FIG. 7A. The second compensator 911 corresponds to a case in which the compensator is formed by periodically arranging the unit pattern shown in FIG. 7C. The third compensator 921 corresponds to a case in which the compensator is formed by periodically arranging the unit pattern shown in FIG. 7D. The fourth compensator 931 corresponds to a case in which the compensator is formed by periodically arranging the unit pattern shown in FIG. 7E. Meanwhile, as the embodiment shown in FIG. 9 is only one embodiment of the disclosure, the scope of the disclosure should not be limited to the embodiment shown in FIG. 9.

Figure 10:
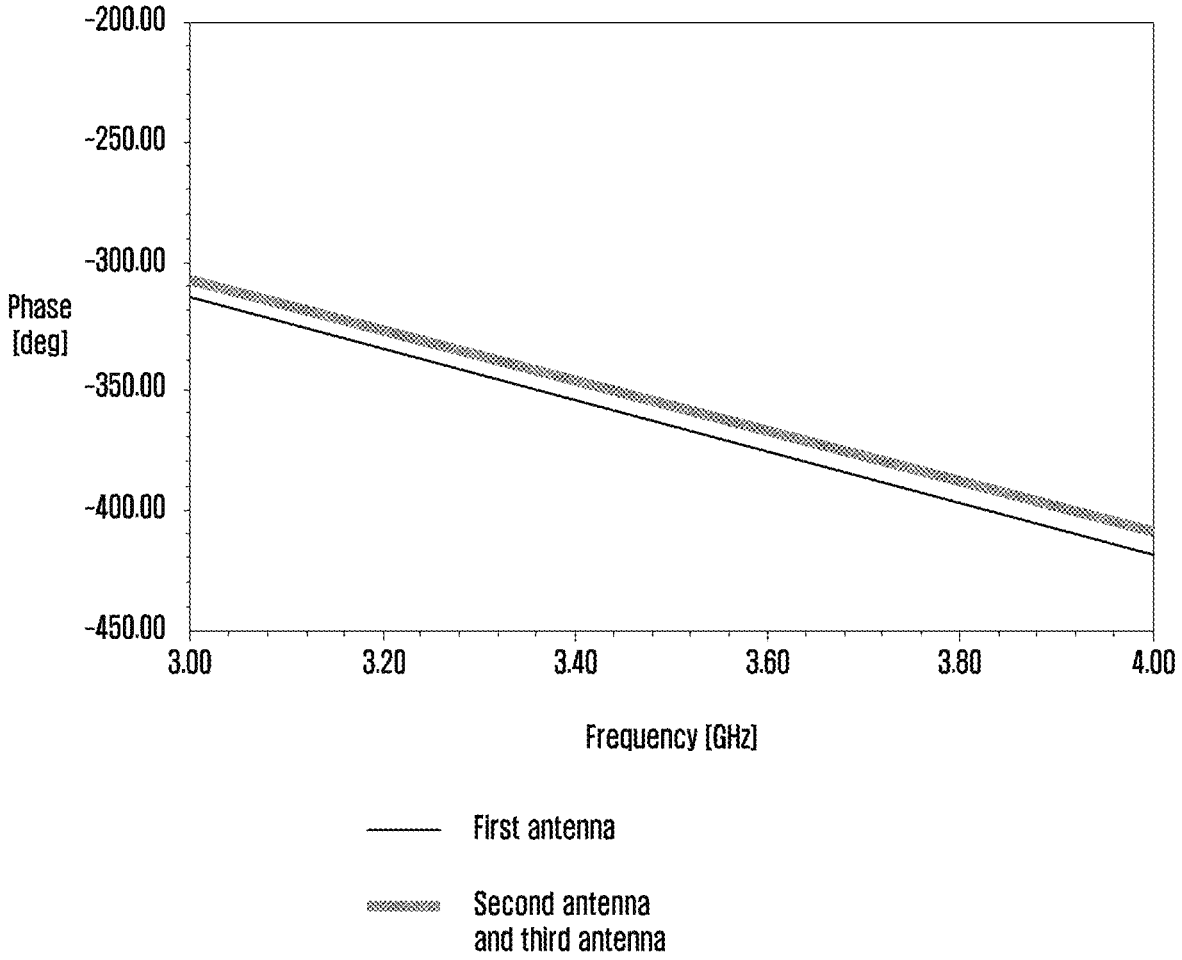
FIG. 10 is a graph showing the phase difference between electrical signals supplied to individual antennas in the antenna module according to an embodiment of the disclosure.

FIG. 10 is a graph showing the phase difference between electrical signals supplied to individual antennas in the antenna module according to an embodiment of the disclosure.

According to the antenna module structure proposed in the disclosure, it can be seen from FIG. 10 that the phase of the electrical signal supplied to the first antenna and the phase of the electrical signal supplied to the second and third antennas are the same regardless of the frequency band. That is, in the antenna module structure proposed in the disclosure, a phase difference between radio waves radiated by individual antennas may not occur even in a wide frequency band, thereby improving the gain of the antenna module.

Figure 11:
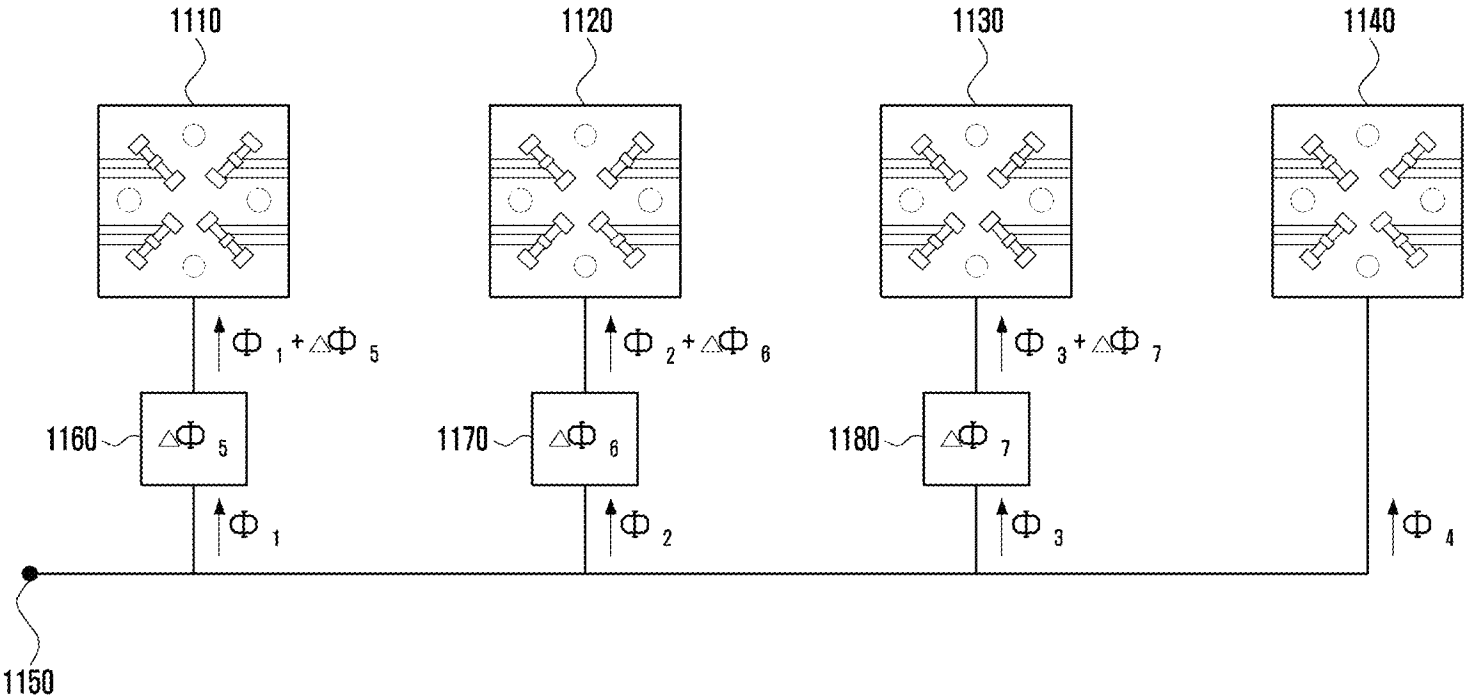
FIG. 11 illustrates the structure of an antenna module including four antennas according to an embodiment of the disclosure.

FIG. 11 illustrates the structure of an antenna module including four antennas according to an embodiment of the disclosure.

In one embodiment, the antenna module may include: a printed circuit board on which at least one layer is stacked and including a feed port 1150 formed at a portion of the upper surface thereof; a first antenna array 1110 disposed on the upper surface of the printed circuit board; a second antenna array 1120 disposed on the upper surface of the printed circuit board and spaced apart from the first antenna array 1110; a third antenna array 1130 disposed on the upper surface of the printed circuit board and spaced apart from the first antenna array 1110 and the second antenna array 1120; a fourth antenna array 1140 disposed on the upper surface of the printed circuit board and spaced apart from the first antenna array 1110, the second antenna array 1120 and the third antenna array 1130; a first feed line electrically connecting the feed port 1150 and the first antenna array 1110; a second feed line electrically connecting the feed port 1150 and the second antenna array 1120; a third feed line electrically connecting the feed port 1150 and the third antenna array 1130; and a fourth feed line electrically connecting the feed port 1150 and the fourth antenna array 1140. In various embodiments, the first feed line may include a first compensator 1160 to adjust the length of the first feed line, the second feed line may include a second compensator 1170 to adjust the length of the second feed line, and the third feed line may include a third compensator 1180 to adjust the length of the third feed line.

In one embodiment, the electrical lengths of the first feed line, the second feed line, the third feed line and the third feed line can be made identical by use of the first compensator 1160 electrically connected to the first feed line, the second compensator 1170 electrically connected to the second feed line, and the third compensator 1180 electrically connected to the third feed line.

In the description, the electrical length may not mean the physical length of a feed line. In one embodiment, the electrical length of a feed line may be a factor that determines the phase of the electrical signal passing through the feed line. For example, the length of a feed line may be a factor for determining the impedance of the feed line.

In one embodiment, when the phase of the electrical signal supplied to the first compensator 1160 is $\varphi_1$, the first compensator 1160 may change the phase of the electrical signal by $\Delta\varphi_5$. That is, the phase of the electrical signal supplied to the first antenna array 1110 may be $\varphi_1+\Delta\varphi_5$ due to the operation of the first compensator 1160. In various embodiments, when the phase of the electrical signal supplied to the second compensator 1170 is $\varphi_2$, the second compensator 1170 may change the phase of the electrical signal by $\Delta\varphi_6$. That is, the phase of the electrical signal supplied to the second antenna array 1120 may be $\varphi_2+\Delta_6$ due to the operation of the second compensator 1170. In one embodiment, when the phase of the electrical signal supplied to the third compensator 1180 is $\varphi_3$, the third compensator 1180 may change the phase of the electrical signal by $\Delta\varphi_7$. That is, the phase of the electrical signal supplied to the third antenna array 1130 may be $\varphi_3+\Delta\varphi_7$ due to the operation of the third compensator 1180. In one embodiment, the phase of the electrical signal supplied to the fourth antenna array 1140 may be $\varphi_4$, and the phases of the electrical signals supplied respectively to the first antenna array 1110, the second antenna array 1120, the third antenna array 1130, and the fourth antenna array 1140 may be the same. That is, in FIG. 11, the values of $\varphi_1+\Delta\varphi_5$, $\varphi_2+\Delta\varphi_6$, $\varphi_3+\Delta\varphi_7$, and $\varphi_4$ may all be the same.

In one embodiment, an antenna module may include: a printed circuit board on which at least one layer is stacked and including a feed port formed at a portion of the upper surface thereof; a first antenna array disposed on the upper surface of the printed circuit board; a second antenna array disposed on the upper surface of the printed circuit board and spaced apart from the first antenna array; a first feed line electrically connecting the feed port and the first antenna array; and a second feed line electrically connecting the feed port and the second antenna array, wherein the first feed line may include a compensator to adjust the length of the first feed line.

In one embodiment, the length of the first feed line may be shorter than the length of the second feed line.

In one embodiment, the phase of the electrical signal supplied to the first feed line through the feed port may be different by 360° from the phase of the electrical signal supplied to the second feed line through the feed port.

In one embodiment, the phase of the electrical signal supplied to the second antenna array through the second feed line may be the same as the phase of the electrical signal supplied to the first antenna through the compensator.

In one embodiment, the compensator may include a metal pattern formed on the upper surface of the printed circuit board by using microstrip patterning.

In one embodiment, the compensator may further include a dielectric layer disposed on the upper surface of the metal pattern to surround the metal pattern, and a metal layer disposed on the upper surface of the dielectric layer to be spaced apart by a preset distance from the metal pattern.

In one embodiment, the antenna module may include a ground layer disposed on the bottom surface of the printed circuit board, and a slot may be formed at a portion of the ground layer facing the upper surface of the printed circuit board on which the metal pattern is formed.

In one embodiment, an antenna module may include: a printed circuit board on which at least one layer is stacked and including a feed port formed at a portion of the upper surface thereof; a first antenna array disposed on the upper surface of the printed circuit board; a second antenna array disposed on the upper surface of the printed circuit board and spaced apart from the first antenna array; a third antenna array disposed on the upper surface of the printed circuit board and spaced apart from the first antenna array and the second antenna array; a first feed line electrically connecting the feed port and the first antenna array; a second feed line electrically connecting the feed port and the second antenna array; and a third feed line electrically connecting the feed port and the third antenna array, wherein the first feed line may include a compensator to adjust the length of the first feed line.

In one embodiment, the length of the first feed line may be shorter than the length of the second feed line and the third feed line, and the length of the second feed line may be the same as the length of the third feed line.

In one embodiment, the phase of the electrical signal supplied to the first feed line through the feed port may be different by 360° from the phase of the electrical signal supplied to the second feed line through the feed port, and the phase of the electrical signal supplied to the first feed line through the feed port may be different by 360° from the phase of the electrical signal supplied to the third feed line through the feed port.

In one embodiment, the phase of the electrical signal supplied to the second antenna array through the second feed line may be the same as the phase of the electrical signal supplied to the first antenna array through the compensator, and the phase of the electrical signal supplied to the third antenna array through the third feed line may be the same as the phase of the electrical signal supplied to the first antenna array through the compensator.

In one embodiment, the compensator may include a metal pattern formed on the upper surface of the printed circuit board by using microstrip patterning.

In one embodiment, the compensator may further include a dielectric layer disposed on the upper surface of the metal pattern to surround the metal pattern, and a metal layer disposed on the upper surface of the dielectric layer to be spaced apart by a preset distance from the metal pattern.

In one embodiment, the antenna module may include a ground layer disposed on the bottom surface of the printed circuit board, and a slot may be formed at a portion of the ground layer facing the upper surface of the printed circuit board on which the metal pattern is formed.

In one embodiment, an electronic device may include an antenna module. The antenna module may include: a printed circuit board on which at least one layer is stacked and including a feed port formed at a portion of the upper surface thereof; a first antenna array disposed on the upper surface of the printed circuit board; a second antenna array disposed on the upper surface of the printed circuit board and spaced apart from the first antenna array; a third antenna array disposed on the upper surface of the printed circuit board and spaced apart from the first antenna array and the second antenna array; a first feed line electrically connecting the feed port and the first antenna array; a second feed line electrically connecting the feed port and the second antenna array; and a third feed line electrically connecting the feed port and the third antenna array, wherein the first feed line may include a compensator to adjust the length of the first feed line.

In one embodiment, the length of the first feed line may be shorter than the length of the second feed line and the third feed line, and the length of the second feed line may be the same as the length of the third feed line.

In one embodiment, the phase of the electrical signal supplied to the first feed line through the feed port may be different by 360° from the phase of the electrical signal supplied to the second feed line through the feed port, and the phase of the electrical signal supplied to the first feed line through the feed port may be different by 360° from the phase of the electrical signal supplied to the third feed line through the feed port.

In one embodiment, the phase of the electrical signal supplied to the second antenna array through the second feed line may be the same as the phase of the electrical signal supplied to the first antenna array through the compensator, and the phase of the electrical signal supplied to the third antenna array through the third feed line may be the same as the phase of the electrical signal supplied to the first antenna array through the compensator.

In one embodiment, the compensator may include a metal pattern formed on the upper surface of the printed circuit board by using microstrip patterning.

In one embodiment, the compensator may further include a dielectric layer disposed on the upper surface of the metal pattern to surround the metal pattern, and a metal layer disposed on the upper surface of the dielectric layer to be spaced apart by a preset distance from the metal pattern.

In one embodiment, the electronic device may include a ground layer disposed on the bottom surface of the printed circuit board, and a slot may be formed at a portion of the ground layer facing the upper surface of the printed circuit board on which the metal pattern is formed.

Although the present disclosure has been described with various embodiments, various changes and modifications may be suggested to one skilled in the art. It is intended that the present disclosure encompass such changes and modifications as fall within the scope of the appended claims.

What is claimed is:

1. An antenna module comprising:

a printed circuit board on which at least one layer is stacked and including a feed port formed at a portion of an upper surface thereof;

a first antenna array disposed on the upper surface of the printed circuit board;

a second antenna array disposed on the upper surface of the printed circuit board and spaced apart from the first antenna array;

a first feed line to electrically connect the feed port and the first antenna array, the first feed line including a compensator to adjust a length of the first feed line; and a second feed line to electrically connect the feed port and the second antenna array, wherein the compensator includes a metal pattern formed on the upper surface of the printed circuit board by using microstrip patterning.

2. The antenna module of claim 1, wherein the length of the first feed line is shorter than a length of the second feed line.

3. The antenna module of claim 2, wherein a phase of an electrical signal supplied to the first feed line through the feed port is different by 360 degrees from a phase of an electrical signal supplied to the second feed line through the feed port.

4. The antenna module of claim 3, wherein the phase of an electrical signal supplied to the second antenna array through the second feed line is the same as a phase of an electrical signal supplied to the first antenna array through the compensator.

5. The antenna module of claim 1, wherein the compensator further includes:

a dielectric layer disposed on an upper surface of the metal pattern to surround the metal pattern; and a metal layer disposed on an upper surface of the dielectric layer to be spaced apart by a preset distance from the metal pattern.

6. The antenna module of claim 1, further comprising a ground layer disposed on a bottom surface of the printed circuit board, wherein a slot is formed at a portion of the ground layer facing the upper surface of the printed circuit board on which the metal pattern is formed.

7. An antenna module comprising:

a printed circuit board on which at least one layer is stacked and including a feed port formed at a portion of an upper surface thereof;

a first antenna array disposed on the upper surface of the printed circuit board;

a second antenna array disposed on the upper surface of the printed circuit board and spaced apart from the first antenna array;

a third antenna array disposed on the upper surface of the printed circuit board and spaced apart from the first antenna array and the second antenna array;

a first feed line to electrically connect the feed port and the first antenna array, the first feed line including a compensator to adjust a length of the first feed line;

a second feed line to electrically connect the feed port and the second antenna array; and a third feed line to electrically connect the feed port and the third antenna array, wherein the compensator includes a metal pattern formed on the upper surface of the printed circuit board by using microstrip patterning.

8. The antenna module of claim 7, wherein:

the length of the first feed line is shorter than a length of the second feed line and the third feed line; and the length of the second feed line is the same as a length of the third feed line.

9. The antenna module of claim 8, wherein:

a phase of an electrical signal supplied to the first feed line through the feed port is different by 360 degrees from a phase of an electrical signal supplied to the second feed line through the feed port; and the phase of the electrical signal supplied to the first feed line through the feed port is different by 360 degrees from a phase of an electrical signal supplied to the third feed line through the feed port.

10. The antenna module of claim 9, wherein:

the phase of an electrical signal supplied to the second antenna array through the second feed line is the same as a phase of an electrical signal supplied to the first antenna array through the compensator; and the phase of an electrical signal supplied to the third antenna array through the third feed line is the same as the phase of the electrical signal supplied to the first antenna array through the compensator.

11. The antenna module of claim 7, wherein the compensator further includes:

a dielectric layer disposed on an upper surface of the metal pattern to surround the metal pattern; and a metal layer disposed on an upper surface of the dielectric layer to be spaced apart by a preset distance from the metal pattern.

12. The antenna module of claim 7, further comprising a ground layer disposed on a bottom surface of the printed circuit board, wherein a slot is formed at a portion of the ground layer facing the upper surface of the printed circuit board on which the metal pattern is formed.

13. An electronic device comprising an antenna module, the antenna module comprising:

a printed circuit board on which at least one layer is stacked and including a feed port formed at a portion of an upper surface thereof;

a first antenna array disposed on the upper surface of the printed circuit board;

a second antenna array disposed on the upper surface of the printed circuit board and spaced apart from the first antenna array;

a third antenna array disposed on the upper surface of the printed circuit board and spaced apart from the first antenna array and the second antenna array;

a first feed line to electrically connect the feed port and the first antenna array, the first feed line including a compensator to adjust a length of the first feed line;

a second feed line to electrically connect the feed port and the second antenna array; and a third feed line to electrically connect the feed port and the third antenna array, wherein the compensator includes a metal pattern formed on the upper surface of the printed circuit board by using microstrip patterning.

14. The electronic device of claim 13, wherein:

the length of the first feed line is shorter than a length of the second feed line and a length of the third feed line; and the length of the second feed line is the same as the length of the third feed line.

15. The electronic device of claim 14, wherein:

a phase of an electrical signal supplied to the first feed line through the feed port is different by 360 degrees from a phase of an electrical signal supplied to the second feed line through the feed port; and the phase of the electrical signal supplied to the first feed line through the feed port is different by 360 degrees from a phase of an electrical signal supplied to the third feed line through the feed port.

16. The electronic device of claim 15, wherein:

the phase of an electrical signal supplied to the second antenna array through the second feed line is the same as a phase of an electrical signal supplied to the first antenna array through the compensator; and the phase of an electrical signal supplied to the third antenna array through the third feed line is the same as the phase of the electrical signal supplied to the first antenna array through the compensator.

17. The electronic device of claim 13, further comprising a ground layer disposed on a bottom surface of the printed circuit board, wherein a slot is formed at a portion of the ground layer facing the upper surface of the printed circuit board on which the metal pattern is formed, wherein the compensator further includes:

a dielectric layer disposed on an upper surface of the metal pattern to surround the metal pattern; and a metal layer disposed on an upper surface of the dielectric layer to be spaced apart by a preset distance from the metal pattern.

* * * * *